United States Patent [19]

Yasukura

[11] 4,134,254

[45] Jan. 16, 1979

[54] ELECTRONIC TIMEPIECE DEVICE

[75] Inventor: Tohru Yasukura, Kunitachi, Japan

[73] Assignee: Casio Computer Co., Ltd., Tokyo, Japan

[21] Appl. No.: 641,308

[22] Filed: Dec. 16, 1975

[30] Foreign Application Priority Data

Dec. 17, 1974 [JP] Japan ..... 49-144708

[51] Int. Cl.[2] ..... G04C 3/00; G04B 19/30; G04B 27/00

[52] U.S. Cl. ..... 58/85.5; 58/50 R

[58] Field of Search ..... 58/23 R, 26, 50 R, 85.5; 328/37, 129; 331/175

[56] References Cited

U.S. PATENT DOCUMENTS

| | | | |
|---|---|---|---|
| 3,792,577 | 2/1974 | Fujita | 58/85.5 |
| 3,812,669 | 5/1974 | Wiget | 58/23 R |
| 3,895,486 | 7/1975 | Hammer et al. | 58/85.5 |
| 3,922,844 | 12/1975 | Sakamoto | 58/85.5 |
| 3,961,472 | 6/1976 | Riehl | 58/4 A |

*Primary Examiner*—Edith S. Jackmon
*Attorney, Agent, or Firm*—Flynn & Frishauf

[57] ABSTRACT

An electronic timepiece device comprising a plurality of coupled counter circuits designed to carry out a successive frequency division of signals issued from a frequency oscillator and supply time-indicating count signals to a time display section, wherein any of the coupled counter circuits is connected to a memory circuit for storing a certain number of counts representing the fraction of a correct time which should be exchanged for that of an incorrect time indicated by the counter circuits due to the frequency oscillating error originally accompanying the frequency oscillator or a certain number of counts by which the operation of the counter circuits should be advanced or delayed to correct the fraction of an incorrect time resulting from said error; a detector for detecting the point of time at which correction of time should be made detects a particular point of time counted by the plural coupled counter circuits as a specified point of time for correction; and upon detection of the specified point of time for correction, said correction time detector sends forth a time correction-instructing signal to the memory circuit coupled to a prescribed counter circuit to correct a count currently presented in said counter circuit to an extent equal to a correction base value previously stored in the corresponding memory circuit.

8 Claims, 4 Drawing Figures

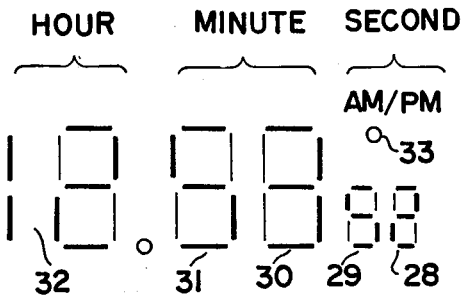
FIG. 3
FIG. 4
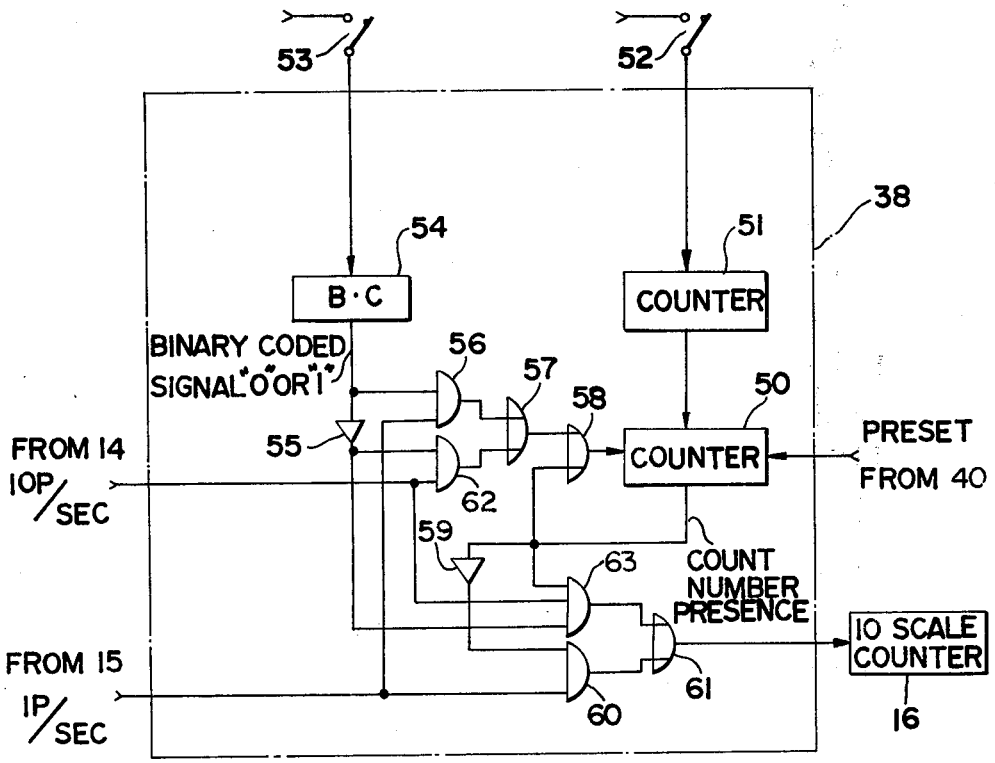

ELECTRONIC TIMEPIECE DEVICE

This invention relates to an electronic timepiece device, wherein signals issued from a frequency oscillator are counted after being subjected to frequency division as time-indicating signals for display of time, and more particularly to a timepiece device admitting of easy correction of time on the part of an electronic timepiece maker or user.

The prior art electronic timepiece device uses a frequency oscillator, for example, a quartz oscillator which has a high stability of frequency oscillation, because a frequency oscillator exerts a direct effect on the precision at which said electronic timepiece device displays time. Even the quartz oscillator presents considerable difficulties in eliminating its frequency oscillating error for the object of elevating the precision of time indication. However, attempts have been made to minimize said error by correction as much as possible. One of such attempts consists in fitting a trimmer capacitor to the oscillation circuit of a quartz oscillator. and controlling the oscillation frequency by said timmer capacitor while measuring the frequency oscillating error of the quartz oscillator.

Though a trimmer capacitor may be used with a quartz oscillator in the case of a relatively large timepiece, practical application of the trimmer capacitor to a timepiece such as a wrist watch which is required to be made as small as possible presents considerable difficulties due to a large area occupied by said trimmer capacitor. Also, once a maker has manufactured, for example, an electronic wrist watch, it was impossible for the user to control its precision.

This invention has been accomplished in view of the above-mentioned circumstances and is intended to provide an electronic timepiece device which enables a user to control said error to provide a correct time by finding the time error resulting from the original frequency oscillating error of a frequency oscillator occurring, for example, during one day or half a day.

SUMMARY OF THE INVENTION

To attain this object, this invention provides an electronic timepiece device which comprises a plurality of counter circuits for carrying out a successive frequency division of signals issued from a frequency oscillator and counting the frequency-divided signals as time indicating signals; a time-correcting circuit including a memory circuit connected to a selected one of a plurality of coupled counter circuits to store a correction base value corresponding to that total time error resulting from a frequency oscillating deviation originally accompanying the frequency oscillator which occurs during n hours, where n is an integer larger than 1; a specified time-detecting circuit for generating a signal indicating the detection of each specified point of time counted by the plural counter circuits during every n hours at which correction should be made; and means for operating a time-correcting circuit which, upon receipt of said detection signal, corrects the count of the counter circuit connected to the time-correcting circuit.

The electronic timepiece device of this invention constructed as described above enables time error to be automatically corrected at a prescribed time interval simply by causing the memory circuit on the part of the user to be stored with a total time error occurring during, for example, one day. Obviously, if a maker ascertains a frequency oscillating error originally accompanying a frequency oscillator used in manufacturing an electronic timepiece and adapts, for example, a read only memory (abbreviated as ROM) in consideration of said detected frequency oscillating error, then correction of time can be automatically effected at a specified point of time. Thus, the electronic timepiece device of this invention admits of easy correction of time on the part of either maker or user. Further, the timepiece device of the invention which detects a total time error occurring during each relatively long period of time, for example, one whole day and carries out time correction on the basis of said detected time error eliminates the necessity of providing a trimmer capacitor immediately behind a frequency oscillator to correct minute changes in the frequency oscillation of a frequency oscillator as is the case with the prior art electronic timepiece device. The resultant reduced space makes the electronic timepiece device of this invention well adapted for use as a small type such as a wrist watch.

BRIEF DESCRIPTION OF THE DRAWINGS

FIG. 3 sets forth an example of the arrangement of display segments included in the respective display units; and FIG. 4 is a concrete block circuit diagram of an electronic timepiece device according to another embodiment of the invention.

DETAILED DESCRIPTION

Figure 1:
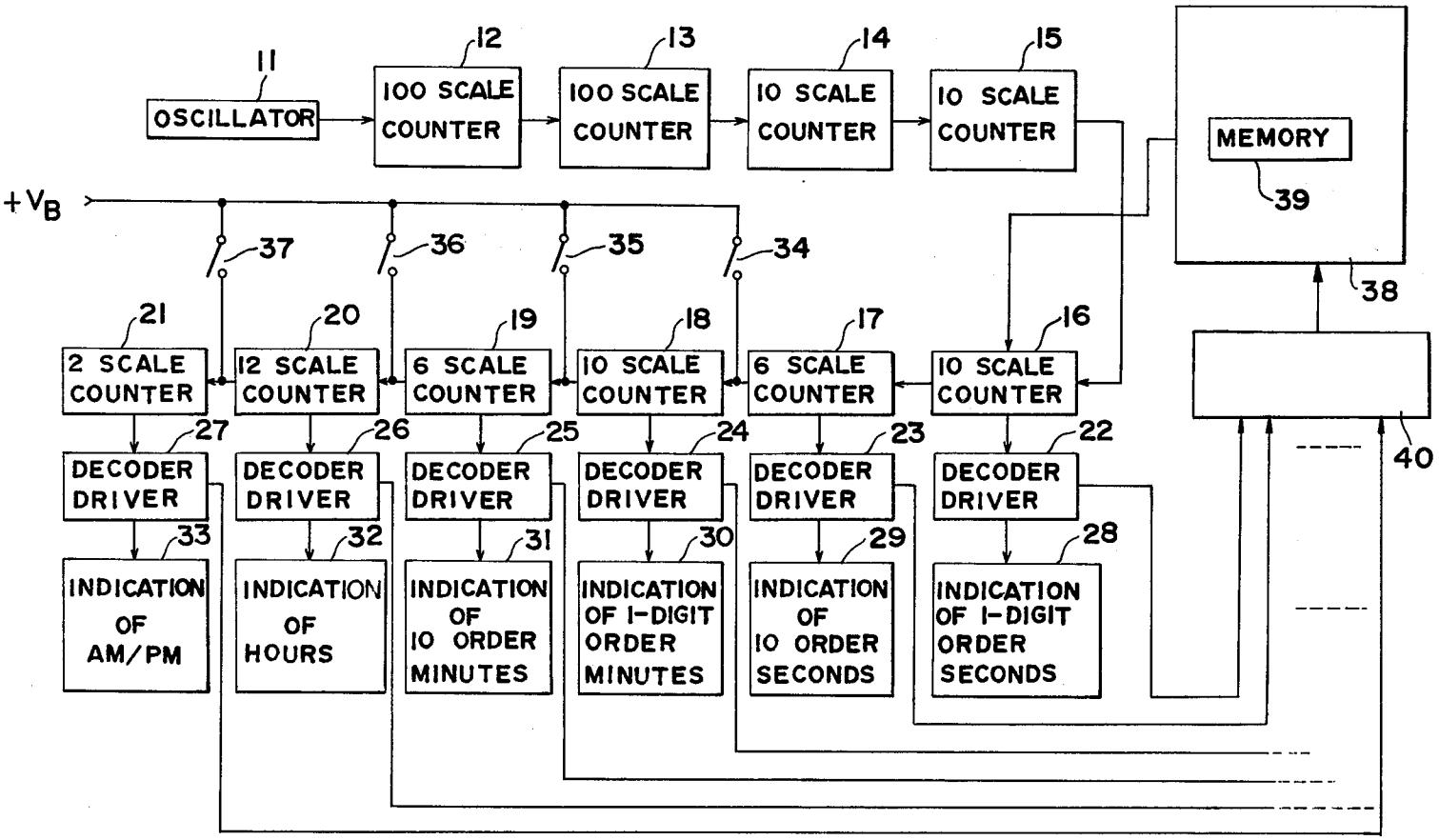
FIG. 1 is a block circuit diagram of an electronic timepiece device according to an embodiment of this invention.

There will now be described by reference to FIG. 1 an electronic timepiece device according to an embodiment of this invention. A frequency oscillator 11 is formed of a quartz oscillator, which is specifically designed to generate a signal having a frequency of, for example, 1 MHz. A frequency oscillator customarily used is of a $10^{15}$ Hz type. For convenience of description, however, this embodiment uses a $10^{6}$ Hz frequency oscillator. Signals issued from said frequency oscillator 11 are subjected to frequency division by 100-scale counters 12, 13 and 10-scale counters 14, 15 in turn finally to provide a 1 Hz signal. This 1 Hz signal is counted to a 10-scale counter 16 which gives forth a count denoting a first place digit of a second. An output from said 10-scale counter 16 is subjected to further frequency division through a 6-scale counter 17, 10-scale counter 18, 6-scale counter 19, 12-scale counter 20 and 2-scale counter 21 in turn to be counted each time. In this case, the counters 12 to 21 produce a carry signal in succession. Namely, the 10-scale counter 16 gives forth a count signal corresponding to the first place digit of a second; the 6-scale counter 17 a count signal corresponding to the 10 order digit of a second; the 10-scale counter 18 a count signal corresponding to the first place digit of a minute; the 6-scale counter 19 a count signal corresponding to the 10order digit of a minute; the 12-scale counter 20 a count signal corresponding to the hour numeral; and the 2-scale counter 21 a count signal denoting the chracters AM and PM. All these count signals are transmitted to the respective display units 28 to 33 through the corresponding decoder drivers 22 to 27 to indicate time. The display units 28 to 33 are formed of liquid crystal or light-emitting diodes. While the dispaly units 28 to 33 present numerals by selection of desired display segments shown in FIG. 3, the display unit 33 indicates symbols representing the characters AM and PM according to whether the digits shown on the display panel belong to the morning or afternoon.

Figure 2:
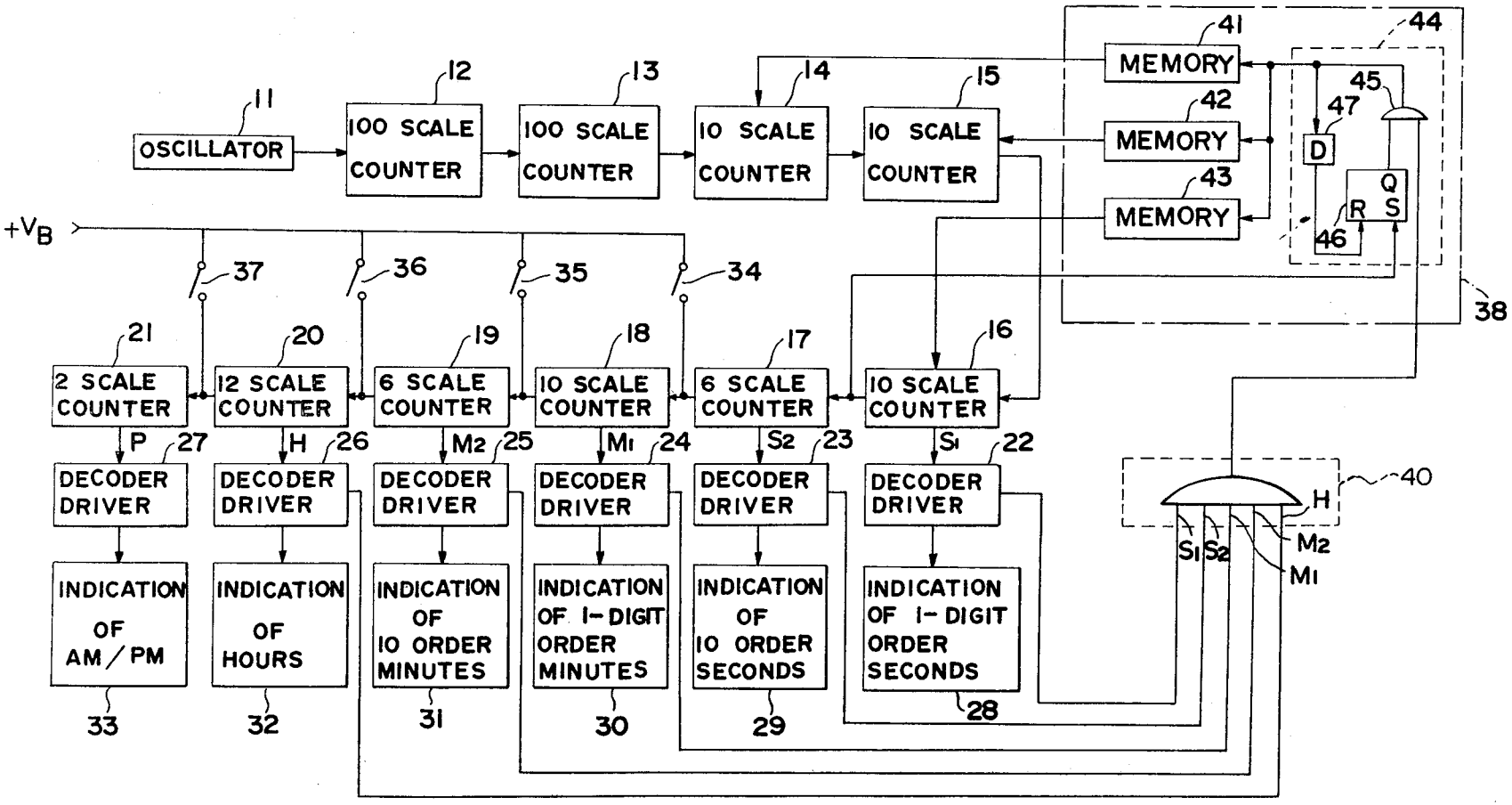
FIG. 2 is a concrete block circuit diagram of the time-detecting circuit and time-correcting circuit used with the timepiece device of this invention.

Referring to FIG. 2, the switches 34, 35, 36, 37, when thrown in, deliver pulses to the counters 18 to 21 to carry out the initial time setting required, for example, when the used battery is exchanged for a fresh one.

A time-correcting circuit 38 is connected to any of the plural counter circuits, for example, the second-indicating counter circuit 16, insofar as the frequency oscillating error of the quartz oscillator 11 can be counterbalanced. The time-correcting circuit 38 contains at least one memory circuit 39 which can be stored with a correction base value corresponding to the frequency oscillating error of the quartz oscillator. The time-correcting circuit 38 is provided with a specified time detector 40 which detects a certain point of time selected from among the counts indicated by the counter circuits 16 to 21. A detection output from said specified time detector 40 is supplied as an operation command to the time-correcting circuit 38.

With the timepiece device of this invention arranged as described above, the frequency oscillating error of the quartz oscillator 11 is detected in advance. A memory 39 included in the time-correcting circuit 38 is stored with a correction base value corresponding to a total time error occurring during each particular period of time which results from said frequency oscillating error. This correction base value is used in correcting the counts of the counter circuits 16 to 21, thereby providing a correct time for each particular period of time. Therefore, it is unnecessary to provide, for example, a trimmer capacitor for the quartz oscillator 11 for correction of its frequency oscillating error, as is the case with the prior art timepiece device.

FIG. 2 is a concrete representation of the time-correcting circuit 38 and specified time detector 40. For briefness of description, the parts of FIG. 2 the same as those of FIG. 1 are denoted by the same numerals and description thereof is omitted. Where a quartz oscillator 11 having such a precision of frequency oscillation as indicates a deviation of $\pm 10^{-4}$ at 1 MHz is used in consideration of the quality of commercially available parts, then said quartz oscillator generates a frequency falling within the range of 999,900 Hz to 1,000,100 Hz, if used without correcting said deviation. Counted for each period of 24 hours or one day, the frequency oscillating error of the quartzoscillator 11 will amount to $\pm 8.640$ seconds at maximum. If the above-mentioned total time error of $\pm 8.640$ seconds is to be corrected for each period of 12 hours, then it is necessary to use a circuit arrangement capable of correcting a time error of $\pm 4.320$. To this end, memories 41, 42, 43 connected to counters 14, 15, 16 are provided for the time-correcting circuit 38. Further, a presetting circuit 44 is provided to store the counter circuits 14, 15, 16 with a correction base value previously stored in said memories 41, 42, 43 respectively.

The presetting circuit 44 comprises an AND circuit 45 which issues a presetting command upon receipt of a signal from a specified time detector 40, and a flip-flop circuit 46 which sends forth a set output to the AND circuit 45. The flip-flop circuit 46 is set by a carry signal given forth from the 10-scale counter 16 at an interval of 10 seconds, and is reset by an output from a delay circuit 47 supplied with an output from the AND circuit 45. The presetting circuit 44 is supplied with a detection output from a correction time detector 40 which represents the counts of the counter circuits 16 to 21, for example, (5 hr 05 sec) obtained for each period of 12 hours. This detection output denotes the point of time at which correction should be made. Said detection output is supplied as a gating signal to the AND circuit 45. The correction time detector 40 is formed of an AND circuit shown in FIG. 2, the gates of which are supplied with counts H, $M_2$, $M_1$, $S_2$, $S_1$ denoting (5 hr 05 sec) which are delivered from the decoder drivers 22 to 26.

Since the flip-flop circuit 46 is set by an output from the 10-scale counter 16, a presetting command is given to the memory circuits 34 to 36, whenever a point of time (5 hr 05 sec) is detected by the specified time detector 40, that is, for each period of 12 hours, thereby correcting the counter circuits 14 to 16. If a total time error presented by the quartz oscillator 11 during each period of 12 hours is determined in advance and the memory circuits 34 to 36 are preset at values corresponding to said total time error, then correction of time can be automatically effected without the possibility of the time error being accumulated.

Where an electronic timepiece happens to gain 1.25 seconds during 12 hours due to the frequency oscillating error of the quartz oscillator 11 used, then it is advised to preset the memory 41 at [5], the memory 42 at [7], and the memory 43 at [3], thereby correcting the counts of the counter circuits to [5 hr 3.75 sec], that is, delaying said timepiece by 1.25 seconds, when detection is made of a point of time [5 hr 05 sec] at which correction should be made.

Conversely where an electronic timepiece happens to lose 1.25 seconds, then the memory 41 is preset at [5], the memory 42 at [2], and the memory 43 at [6], thereby correcting the counts [5 hr 05 sec] indicated by the counter circuits to [5 hr 6.25 sec].

In the above-mentioned case, it is advisable for the electronic timepiece maker to use an ROM type capable of being stored with a program as the memory circuits 41, 42, 43, cause said memory circuits to be previously stored with a correction base value corresponding to a total time error occurring during a period of, for example, 12 hours which is caused by a frequency oscillating error originally accompanying a quartz oscillator 11 used and preset the counter circuits 14 to 16 at said corrrection base value read out from the memory circuits 41, 42, 43 upon receipt of a presetting command.

It is further possible to form the memory circuits 41 to 43 to the rotary switch type, followed by presetting, or preset counter circuits at a correction base value by external input means.

The specified time detector 40 may be designed not only to detect any optional correction time, but also a plurality of correction times. The point is that said specified time detector 40 be so designed as to match the values at which the memory circuits 41 to 43 are to be preset.

The user can automatically correct indications on an electronic timepiece for each relatively long period, for example, one day or half a day by causing the memory circuits 41, 42, 43 to be stored with a total time error resulting from the frequency oscillating error of a quartz oscillator which occurs during said period.

Correction of the counts of the counter circuits 14, 15, 16 is carried out by presetting them at the correction base value previously stored in the memory circuits 41, 42, 43 upon receipt of a presetting command from the correcting circuit 38.

There will now be described by reference to FIG. 4 a timepiece device according to another embodiment of this invention which carries out correction of time by causing the counter circuits to make increased counting or to have their operation temporarily suspended, in order to advance or delay time indications on the display panel. According to the embodiment of FIG. 4, the count of the counter circuit 16 representing, for example, the first place digit of a second is corrected by accelerating or decelerating counting by said counter circuit 16. This operation corresponds to the presetting operation of FIG. 2 in which a detection output from the specified time detector 40 causes the memory circuits 41, 42, 43 to be preset at, fresh counts in place of those currently presented.

Where an electronic timepiece using a quartz oscillator is found to indicate an error of 3 seconds for each period of 12 hours or half a day due to the original frequency oscillating error of said quartz oscillator, then a detection output from the specified time detector 40 is supplied as a trigger signal to a down counter 50 included in the time-correcting circuit 38 for each period of 12 hours. The down counter 50 is provided with an output terminal which produces a "1" output when a count is presented in said counter 50 and gives forth a "0" output when a count is not presented therein. The down counter 50 is also connected through operation of a switch 52 to a counter 51 which is previously stored with a count of "3" corresponding to a correction base value of 3 seconds. The count of "3" is shifted to the down counter 50 upon receipt of a detection output from the specified time detector 40. When said correction base value of 3 seconds denotes the advance of an electronic timepiece, then a switch 53 is thrown in to cause a binary counter 54 to generate a binary coded signal of "1," which in turn is carried to one of the gates of an AND circuit 56. The other gate of the AND circuit 56 is supplied with an output from the counter 15 corresponding to 1 p/sec. The 1 p/sec. output from the AND circuit 56 passes through OR circuits 57, 58 to cause the down counter 50 to count down. While the down counter 50 produces an output corresponding to the correction base value of 3 seconds, that is "1" output, this "1" output is converted into a "0" signal by an inverter 59, to prevent an output from the counter 15 from being supplied to the 10-scale counter 16, thereby counterbalancing an advance of 3 seconds by a delay of 3 seconds to provide a correct time. When, after said 3-second delay, the down counter 50 generates a "0" output, that is, ceases to produce a "1" output, then the inverter 59 gives forth a "1" output. An output from the counter 15 corresponding to 1 p/sec. is supplied to the 10-scale counter 16 through an AND circuit 60 and OR circuit 61, enabling said 10-scale counter 16 to continue correct counting representing the first place digit of a second through the above-mentioned correcting process.

Where an electronic timepiece is shown to lose 3 seconds for each period of 12 hours, then a signal showing the detection of a specified time at which correction should be made is transmitted to the down counter 50 for each period of 12 hours in the same manner as described above the supply said counter 50 with a correction base value of 3 seconds already stored in the counter 51. When, under this condition, the switch 53 is so operated as to cause the binary counter 54 to give forth a binary coded signal "0," then said "0" output is converted into a "1" signal by an inverter 55. This "1" signal and a 10 p/sec. output from the counter 14 are delivered to the down counter 50 through an AND circuit 62 and OR circuits 57, 58 in turn. While the down counter 50 continues down counting, a "1" output therefrom, an output from the inverter 55 and a 10 p/sec. output from the counter 14 are supplied to an AND circuit 62. The 10 p/sec. output from the AND circuit 62 is supplied to the counter 16 through the OR circuit 61, causing said counter 16 to accelerate the counting of the first place digit of a second by 3 seconds until the down counter 50 generates a "0" output. As the result, a delay of 3 seconds is automatically corrected for each period of 12 hours.

With the embodiment of FIG. 3, information on the type of time error, that is, the advance or delay of time indication on the display panel of an electronic timepiece and the correction base value by which said advance or delay should be counterbalanced is supplied through the switches 53, 52. If, however, these switches 53, 52 are externally provided, the user can easily attain the precision of time indication. Or, if an electronic timepiece maker undertakes to realize said precision, then the switches 53, 52 may be set inside the timepiece. Further, the switches 53, 52 may be replaced by the ROM type memory circuit used in the embodiment of FIG. 2. With the foregoing embodiments, the memory included in the time-correcting means was stored with a correction base value corresponding to a total time error occurring during each specified period of time. However, it is possible to fix said correction base value in advance, measure a period of time required for said correction base value to be reached, store the memory with said period and read out from the memory a signal detecting the arrival of the starting point of said period. All the above-mentioned embodiments were designed to correct either type of time error, that is, the advance or delay of an electronic timepiece. If, however, an electronic timepiece using a quartz oscillator is found to have a tendency to present before correction one type of time error, that is, only in the direction of advance or delay, then correction of said only one type of error serves the purpose.

What is claimed is:

1. An electronic timepiece device comprising:

a plurality of coupled counter circuits for carrying out a successive frequency division of signals issued from the frequency oscillator and counting the frequency-divided signals as time-indicating signals;

a specified time detecting circuit for generating a signal indicating the detection of that specified point of time counted by the plural counter circuits during every n hours, where n denotes an integer larger than 1, at which correction should be made;

memory means for storing a correction base value corresponding to that time error resulting from a frequency oscillating deviation originally accompanying the frequency oscillator which occurs during n hours;

control signal generating means for producing a binary control signal by designating whether said time error is a gain or loss of time; and count-controlling means connected between a selected two of said plural counter circuits for controlling, upon receipt of a detection output from the specified time-detecting circuit, the pulses causing advancing of counting in the preceding one of the selected two counter circuits according to the binary control signal from said control means and the correction base value in said memory means.

2. An electronic timepiece device comprising a source of high frequency signals;

a multi-stage counter circuit connected to said signal source for frequency-dividing and counting said signals from said signal source and to provide time counting signals for time display;

a specified time-detecting circuit coupled to said counter circuit for detecting signals delivered by said counter circuit and for generating a detection output only every n hours when said counter circuit reaches a count value corresponding to at least one predetermined time of day as counted by said counter circuit and which is a function of the oscillating frequency deviation inherent to said signal source during said every n hours, wherein n denotes an integer larger than 1;

a memory circuit connected to at least one selected stage of said counter circuit for storing the value of a selected time unit of the local standard time at which said counter circuit reaches said count value, said stored value of the selected time unit serving as a correct time value to replace an incorrect time value which is incorrect due to said oscillating frequency deviation; and presetting means coupled to said counter circuit for presetting into said at least one selected stage of said counter circuit the correct time value stored in said memory circuit in response to a detection output from said specified time-detecting circuit, thereby correcting the time displayed.

3. An electronic timepiece device according to claim 2, further comprising time display means coupled to said counter circuit to display time as a function of said time counting signals.

4. The electronic timepiece device according to claim 3, wherein said counter circuit include a second-counting circuit, and said presetting means is connected to said second-counting circuit.

5. An electronic timepiece device according to claim 2 wherein n is equal to 12.

6. An electronic timepiece device according to claim 2 wherein n is equal to 24.

7. An electronic timepiece device according to claim 1 wherein n is equal to 12.

8. An electronic timepiece device according to claim 1 wherein n is equal to 24.

* * * * *